United States Patent [19]

Okada et al.

[11] 4,359,625

[45] Nov. 16, 1982

[54] METHOD OF PREHEATING IMMERSION NOZZLE FOR CONTINUOUS CASTING

[75] Inventors: Tamio Okada, Warabi; Kazumasa Murakami, Nagoya, both of Japan

[73] Assignee: Nippon Crucible Co., Ltd., Tokyo, Japan

[21] Appl. No.: 91,923

[22] Filed: Nov. 7, 1979

[30] Foreign Application Priority Data

Nov. 7, 1978 [JP] Japan ..... 53-137151

[51] Int. Cl.[3] ..... B22D 11/10; B67D 5/62; H05B 3/40

[52] U.S. Cl. ..... 219/300; 137/341; 164/437; 164/438; 219/427; 222/590; 222/593; 222/146 HE

[58] Field of Search ..... 219/300, 301, 427; 13/33; 222/590–593, 146 HE, 146 R; 164/438, 437; 137/341

[56] References Cited

U.S. PATENT DOCUMENTS

| | | | |
|---|---|---|---|
| 469,454 | 2/1892 | Rogers | 222/593 X |
| 2,729,734 | 1/1956 | Decker | 13/33 X |
| 2,959,757 | 11/1960 | Tama et al. | 13/33 X |
| 3,435,992 | 4/1969 | Tisdale | 222/146 R |
| 3,567,082 | 3/1971 | Tinnes | 222/593 X |
| 3,596,804 | 3/1971 | Barrow et al. | 222/593 |
| 3,604,598 | 9/1971 | Kappemeyer | 222/146 HE |
| 3,628,706 | 12/1971 | Todd | 222/591 |
| 3,765,571 | 10/1973 | Lyman | 164/438 |
| 3,788,383 | 1/1974 | Metz | 164/437 X |
| 4,161,647 | 7/1979 | Carbomnel | 222/146 HE |

FOREIGN PATENT DOCUMENTS

| | | | |
|---|---|---|---|
| 129407 | 7/1919 | United Kingdom | 219/427 |

*Primary Examiner*—A. Bartis

*Attorney, Agent, or Firm*—Sughrue, Mion, Zinn, Macpeak & Seas

[57] ABSTRACT

An immersion nozzle for continuous casting resistant to the corrosive action of the melt and the covering material in a mold is made of a refractory material comprising a mixture of electrically conductive graphite and/or silicon carbide, at least one member selected from the group consisting of alumina, zircon, zirconia, fused silica and a metallic silicon, and a binder. The nozzle is covered with a thermal insulating cover having a thickness of approximately 60 mm and made of fused silica containing fibers. The nozzle is preheated without moving it from its operating position by connecting a pair of electrical terminals to opposite ends thereof and passing electric current through the nozzle between the terminals for a period of time sufficient to raise the temperature of the nozzle sufficiently to prevent cracking, spalling, etc. during casting operation. After the preheating is completed the terminals may be removed from the nozzle. The insulating cover may be retained on the nozzle during tapping or the portion thereof that is immersed in the melt may be cut away.

2 Claims, 5 Drawing Figures

METHOD OF PREHEATING IMMERSION NOZZLE FOR CONTINUOUS CASTING

BACKGROUND OF THE INVENTION

1. Field of the Invention

This invention relates to a method of preheating an immersion nozzle for continuous casting.

2. Description of the Prior Art

As well known in the art, immersion nozzles for continuous casting are used under conditions so severe that they are required to have high spalling resistance. To meet the requirement, they are generally made of an appropriate combination of a fused silica-containing material, a graphite-alumina containing material, a silicon carbide-containing material, a zircon-containing material and a zirconia-containing material. Nozzles made of these materials must be heated thoroughly prior to their use. Preheating has conventionally been performed within an oven located far from the place of use. Gas has been a common medium for preheating but at least two hours are required to heat the nozzle to about 800° C. Furthermore, so much time is involved removing the nozzle from the oven and installing it at a predetermined location that a temperature drop is inevitable in that interval. In addition, installing an object heated to high temperatures is difficult. What is more, if the temperature loss is excessive, cracking of the nozzle may occur or the deposit of inclusions such as $Al_2O_3$ in the nozzle opening may render tapping impossible.

SUMMARY OF THE INVENTION

As a result of various studies directed to a method of preheating free from the above defects it has been found that by using the resistance heat developed by the passage of current directly through an immersion nozzle, the nozzle can be heated without moving it from its operating position. The nozzle employed has a suitable electrical resistivity and is provided with a thermal insulating cover which is of a sufficient thickness so as to allow a substantial shortening of the time otherwise required for preheating. Materials of which the nozzle may be made include mixtures containing electrically conductive graphite and/or silicon carbide.

DETAILED DESCRIPTION OF THE INVENTION

Figure 1:
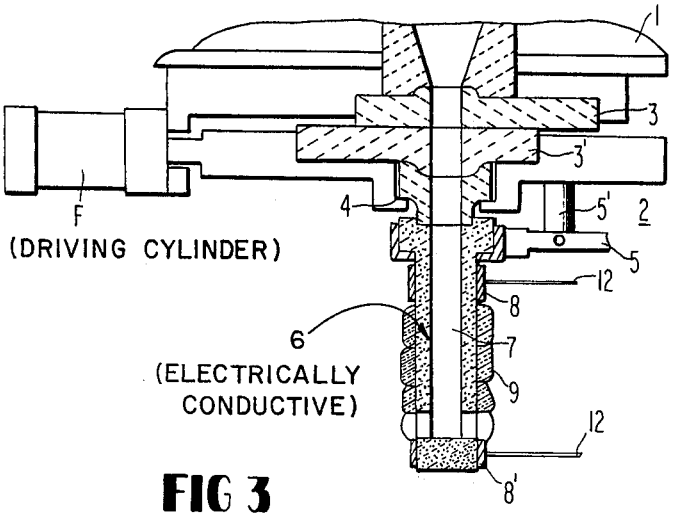
FIG. 1 is a cross section of a heating apparatus in accordance with one embodiment of this invention.

This invention is described by reference to FIG. 1 which illustrates a heating apparatus in accordance with one embodiment of this invention wherein a tap hole opening/closing apparatus 2 (e.g., sliding nozzle valve) disposed at the bottom of melt container 1 comprises a fixed refractory plate 3, a sliding refractory plate 3' driven by a cylinder F, an engaging member 4 at the bottom of the sliding refractory plate 3', an immersion nozzle 6 detachably associated with the engaging member 4 by means of an actuating rod 5, and a nozzle conduit 7. The rod 5 for connecting 4 and 6 is pivotably mounted on a supporting leg 5' attached to the frame of the opening/closing apparatus 2.

The immersion nozzle 6 is made of a refractory material which has a suitable electrical resistivity and is resistant to the corrosive action of the melt and the covering material (powder) of the melt in the mold. A suitable material comprises a mixture of an electrically conductive graphite and/or silicon carbide and at least one member selected from the group consisting of alumina, zircon, zirconia, fused silica and metallic silicon and a binder blended therewith. A nozzle made of such material is provided with terminals 8, 8' at both ends to which current is applied through conductors 12 until the nozzle is adequately heated.

Figure 2:
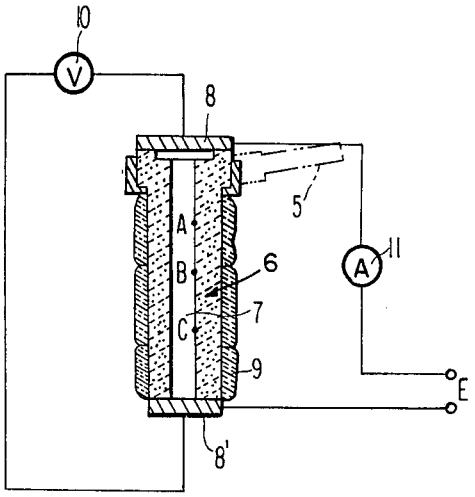
FIG. 2 is a cross section of a heating apparatus in accordance with another embodiment of this invention.

FIG. 2 shows another embodiment of this invention wherein current is passed through the nozzle 6 which is attached to the actuating rod 5 but does not make an intimate contact with the nozzle engaging member 4. Terminals 8, 8' are provided at both ends of the nozzle 6. In the figures, a heat insulating cover 9 is made, for instance, of fused silica containing fibers and surrounds the outer periphery of the nozzle 6. Also, FIG. 2 shows a voltmeter 10, an ammeter 11 and an A.C. power unit E.

Upon completion of preheating, the terminals for the electric current supply are removed from the nozzle. Tapping can start immediately after the removal of the terminals in the embodiment of FIG. 1, or after removing the terminals and bringing the nozzle 6 into intimate contact with the engaging member 4 by the operation of the rod 5 in the embodiment of FIG. 2. Little temperature drop occurs in either embodiment. The insulating cover 9 may be retained on the nozzle during tapping or the portion that is immersed in the melt may be cut away.

This invention will hereunder be described in the greater detail by reference to the following examples which are given here for illustrative purposes only and are by no means intended to limit the scope of the invention.

EXAMPLE 1

Figure 3:
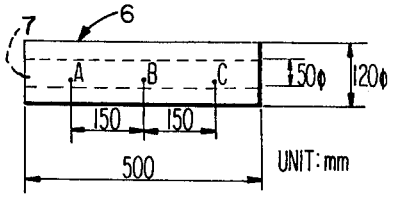
FIGS. 3 and 4 illustrate the dimensions of sample immersion nozzles and the positions at which temperature measurement was made.
Figure 5:
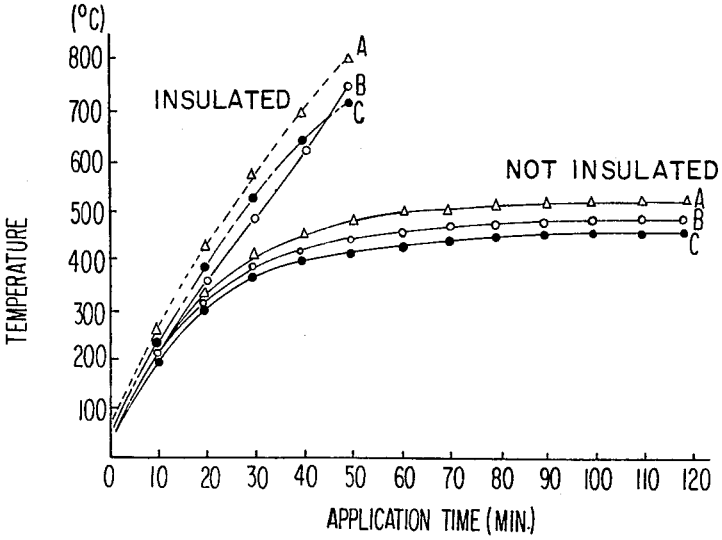
FIG. 5 is a graph showing the relationship between current application time and the resulting temperature increase.

An immersion nozzle (500 mm in overall length, 120 mm in outside diameter, and 50 mm in inside diameter) was supplied with a DC current through copper terminals attached to both ends of the nozzle. The increase in temperature was measured at points A, B and C of the nozzle conduit indicated in FIG. 3. A scale-like graphite was placed between each copper terminal and the nozzle to minimize the possible contact resistance. The results of the measurement are set forth in Table 1 and FIG. 5. When an insulating cover about 60 mm thick was used, a temperature of about 800° C. could be obtained in about 50 minutes.

| Composition of Immersion Nozzle (wt. %) | | | |
|---|---|---|---|
| $Al_2O_3$ | C | SiC | $SiO_2$ |
| 60 | 29 | 7 | 4 |
| Specific Resistivity | | | |
| at 50° C. | | $16.5 \times 10^{-3}$ Ωcm | |
| at 500° C. | | $13.1 \times 10^{-3}$ Ωcm | |
| Nozzle Dimension | | | |
| Overall Length | | 500 mm | |
| Outside Diameter | | 120 mm | |
| Inside Diameter | | 50 mm | |

TABLE 1

| Current Time (min.) | Temperature (°C.) Point A | Point B | Point C | Voltage (V) | Current (A) | Power (KW) | Resistivity (Ω) × $10^{-3}$ | Specific Resistivity Ω-cm × $10^{-3}$ |
|---|---|---|---|---|---|---|---|---|
| | | | | With Insulating Cover | | | | |
| 10 | 252 | 209 | 228 | 4.05 | 550 | 2.23 | 7.36 | 13.12 |
| 20 | 439 | 352 | 383 | 4.15 | 566 | 2.35 | 7.33 | 13.06 |
| 30 | 573 | 485 | 528 | 3.89 | 583 | 2.27 | 6.67 | 11.89 |
| 40 | 693 | 633 | 645 | 3.37 | 591 | 1.99 | 5.70 | 10.18 |
| 50 | 804 | 750 | 733 | 3.28 | 625 | 2.05 | 5.25 | 9.36 |
| | | | | Without Insulating Cover | | | | |
| 10 | 214 | 195 | 202 | 3.19 | 616 | 1.97 | 5.18 | 9.23 |
| 30 | 416 | 365 | 382 | 3.67 | 596 | 2.19 | 6.16 | 10.98 |
| 50 | 481 | 420 | 438 | 3.70 | 596 | 2.21 | 6.21 | 11.07 |
| 70 | 503 | 444 | 467 | 3.70 | 604 | 2.28 | 6.24 | 11.12 |
| 90 | 510 | 450 | 469 | 3.83 | 600 | 2.30 | 6.38 | 11.37 |
| 110 | 517 | 450 | 474 | 3.95 | 591 | 2.33 | 6.68 | 11.90 |
| 130 | 521 | 450 | 473 | 3.96 | 600 | 2.38 | 6.60 | 11.76 |

Insulating Cover about 60 mm Thick

TABLE 2

| Heating with Insulating Cover about 60 mm Thick | | |
|---|---|---|
| Current Time (min.) | Power (KW) | Temperature Point (D) (°C.) |
| 10 | 1.91 | 95 |
| 20 | " | 159 |
| 30 | " | 224 |
| 40 | " | 288 |
| 50 | " | 346 |
| 60 | " | 406 |
| 70 | " | 465 |
| 80 | " | 518 |
| 90 | " | 572 |
| 100 | " | 625 |
| 110 | " | 674 |
| 120 | " | 724 |

EXAMPLE 2

Figure 4:
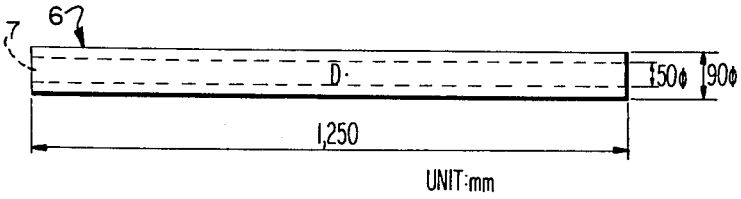

An immersion nozzle (1,250 mm in overall length, 90 mm in outside diameter, and 50 mm in inside diameter) was supplied with a DC current through copper terminals attached to both ends of the nozzle. The increase of temperature was measured at the center D of the nozzle conduit indicated in FIG. 4. The results of the measurement are set forth in Table 2. When an insulating cover about 60 mm thick was used, a temperature of about 724° C. could be obtained in about 120 minutes, and the preheated nozzle performed with good results.

As described above, the application of the preheating method of this invention can be continued up to just before use of the nozzle and hence little temperature loss results. Therefore, not only can cracking of the refractory for the nozzle or formation of the deposit of inclusions within the nozzle be prevented but also the period for preheating can be shortened.

| Composition of Immersion Nozzle (wt. %) | | | |
|---|---|---|---|
| $Al_2O_3$ | C | SiC | $SiO_2$ |
| 60 | 29 | 7 | 4 |
| Specific Resistivity | | | |
| at 50° C. | | 16.5 × $10^{-3}$ Ωcm | |
| at 500° C. | | 13.1 × $10^{-3}$ Ωcm | |
| Nozzle Dimension | | | |
| Overall Length | | 1,250 mm | |
| Outside Diameter | | 90 mm | |
| Inside Diameter | | 50 mm | |

While the invention has been described in detail and with reference to specific embodiments thereof, it will be apparent to one skilled in the art that various changes and modifications can be made therein without departing from the spirit and scope thereof.

What is claimed is:

1. A method of preheating an immersion nozzle for continuous casting, comprising:

providing a nozzle made of an electrically conductive refractory material having sufficient resistance so that, upon being subjected to the passage of current therethrough, said nozzle is caused to be heated, said material of said nozzle being resistant to the material of the melt in a mold, and said material comprising a mixture of an electrically conductive graphite and/or silicon carbide and at least one member selected from the group consisting of alumina, zircon, zirconia, fused silica and a metallic silicon, and a binder;

covering said nozzle with a thermal insulating cover having thermal insulating properties and a thickness of approximately 60 mm sufficient to allow a substantial decrease in the time required for preheating said nozzle up to a desire temperature;

connecting a pair of electrical terminals to opposite ends of said nozzle and in electrical contact therewith; and passing electric current through said nozzle between said terminals for a period of time sufficient to raise the temperature of said nozzle to said desired level.

2. The method of claim 1 further comprising the step of, after completion of preheating, removing the terminals for the electric current supply from the nozzle.

* * * * *